US005980384A

United States Patent [19]

Barrie

[11] Patent Number: 5,980,384

[45] Date of Patent: Nov. 9, 1999

[54] GAMING APPARATUS AND METHOD HAVING AN INTEGRATED FIRST AND SECOND GAME

[76] Inventor: Robert P. Barrie, 232 Amherst Rd., Merrimack, N.H. 03054

[21] Appl. No.: 08/982,988

[22] Filed: Dec. 2, 1997

[51] Int. Cl.[6] ..... A63F 9/24

[52] U.S. Cl. ..... 463/16; 273/143 R; 273/138.1

[58] Field of Search ..... 273/143 R, 138.1, 273/138.2, 138.3, 138 A, 121 B, 269, 138 R; 463/16–20, 12–13, 30–31

[56] References Cited

U.S. PATENT DOCUMENTS 5,393,057 2/1995 Marnell, II ..... 273/269

*Primary Examiner*—Valencia Martin-Wallace
*Assistant Examiner*—Sheila Clayton
*Attorney, Agent, or Firm*—Joseph E. Funk

[57] ABSTRACT

A gaming apparatus and method are disclosed in which there is a primary game and a secondary game that are dynamically linked, and the primary game can be won independently of the secondary game. The primary game may be won on each play of the game, and the secondary game may be won over a plurality of plays of the primary game. Primary game symbols appearing during plays of the primary game may cause: (i) movement of primary game symbols to secondary game display positions; (ii) primary game symbols directing play options of secondary game symbols; (iii) changing the options open to the player in his or her attempt to win the secondary game; (iv) symbols in the primary game being used as soft buttons to affect movement of game symbols from the primary game to the secondary game, and between symbol display positions in the secondary game; and (v) secondary game symbols persisting to subsequent plays of the primary game to help the player to win at the secondary game.

55 Claims, 5 Drawing Sheets

GAMING APPARATUS AND METHOD HAVING AN INTEGRATED FIRST AND SECOND GAME

FIELD OF THE INVENTION

The present invention relates to a gaming apparatus and method in which there is a first or primary game and a second or secondary game occurring simultaneously. The primary game can be won independently of the secondary game. Game symbols appearing during successive plays of the primary game cause both the random appearance of secondary game symbols and a dynamically changing set of options (including symbol transpositions) affecting the secondary game, the symbols displayed in the secondary game, and the continuing game strategy over multiple plays of the primary game.

BACKGROUND OF THE INVENTION

A number of electronic gaming devices, including those commonly found in gaming casinos, include a visual display which show a number of gaming symbols. In previous gaming devices each of these symbols typically has the potential to change from one round of a game to the next. For example, in a simulated slot machine, the symbols that are displayed to simulate the symbols that appear when slot machine reels have stopped are gaming symbols and have the potential to change with each handle pull or other play of the slot machine.

In some situations it is desirable to provide the player with a measure of decision making by which the player can optimize his/her chances of winning. This increases player involvement and entertainment value. Draw Poker games where a player chooses which cards to keep and which to discard are a good popular example of a game with an "optimizing" skill.

In some situations, it is desirable to provide a gaming environment in which players are motivated to play multiple rounds of a game. What constitutes a "round" of a game varies from game to game, but is generally initiated by a user providing an input that signals the user's desire or commitment to playing the round, such as pulling a handle, pushing a button and the like, often accompanied by placing of a bet or wager. Typically, payment of a monetary prize or the awarding of points or credits is done only in response to the playing of a round of a game. For example, a round of a reel slot machine game (often referred to as a "spin") typically involves pulling the slot machine handle, waiting for the reels to stop spinning, evaluating the results, and giving any awards won.

It is believed an environment which encourages play of multiple rounds of a game would add to the player's interest in a particular game, thus increasing entertainment value, and potentially increasing revenue to the casino or other game operator. However, previous gaming environments which provide for a playing field in which symbols can always change from round to round (i.e. in which the symbols displayed on a gaming field are always independent of one another) has provided little opportunity to encourage players to play multiple rounds of a game.

Thus, there is a need in the gaming art for new games that will encourage play of multiple rounds of a game, add to a player's interest in a particular game, and increase entertainment value.

SUMMARY OF THE INVENTION

An encouraging game environment will be provided in games that have a primary game and a physically integrated secondary game, and a player is provided the chance to win separately at the two games. The two integrated games make it appear to the player that there is an increased chance to win. Action in the secondary game is typically triggered in two ways: (1) by some event in a single play of the primary game and, (2) game strategy dependent on and spanning a number of primary game plays. In both cases, the primary game controls events in the secondary game, but events in secondary games may be used to control events in the primary game.

In accordance with a first and a second feature of the present invention, a gaming apparatus and method is provided having a primary game and an integrated secondary game. Each of the two integrated games include indicators or symbols which are positioned on the playing field of each of the games; positioned in such a way as to lend and suggest physical interaction between the two games. This interaction takes the form of: 1) primary game symbols moving to secondary game positions, and 2) primary symbols directing play options of secondary game symbols. This directing of secondary game play options may include, but is not limited to, the movement of secondary game symbols from one secondary game symbol position to another.

Some game symbols that appear in the physically integrated secondary game depend on game symbols that appear in the primary game after a spin or play. In addition, special "Flip-Flop" symbols that may appear in the primary game may cause transposition of game symbols that appear in the secondary game. The player may make the decision to permit symbol transpositions from the primary game to the secondary game, or from one secondary game position to another secondary game position to increase the chances of winning the secondary game. This decision making is the previously mentioned "optimizing skill" exercised by the player.

In accordance with a third feature of the present invention the secondary game spans a multiplicity of plays of the primary games, and each primary game play changes the options open to the player in his or her attempt to win the secondary game. This decision making among options constitutes a desirable "optimizing skill". In states where there is a prohibition against games that allow a player to exercise such optimizing skills, such decisions regarding the secondary game will be made by solely by the gaming software.

In one embodiment of the invention the player initiates a round of a reel slot type machine game (often referred to as a "spin" or "play") by pulling the slot machine handle or pushing a button and waiting for the reels to stop spinning. If a row of common symbols appear, which may include wild card symbols such as Jokers, in the primary game the player has a win. In variants of the primary game where there are multiple rows of symbols displayed, if a column or diagonal line of common symbols appear in the primary game, the player has a win or gains some other game advantage.

In accordance with a fourth feature of the invention, symbols in the primary game are used as soft buttons by a player to specify movement of symbols from the primary game to the secondary game, or transposition of symbols in the secondary game. To implement such game decisions made by the player the game display may utilize touch screen technology which is well known in the art.

In accordance with a fifth feature of the invention some or all of the secondary game symbols and their display positions from previous game plays, whether transposed or not, persist through subsequent plays of the primary game and help the player to win at the secondary game. In variants of the secondary game, if a row, column or diagonal line of common symbols appear in the secondary game, the player has a win or gains some other game advantage.

Thus, in summary, the use of my novel game permits: (i) physical integration of primary and secondary games including, but not limited to, moving primary game symbols to secondary game positions; (ii) primary game symbols directing play options of secondary game symbols; (iii) secondary games spanning a multiplicity of plays of the primary game, and each primary game play changes the options open to the player in his or her attempt to win the secondary game; (iv) symbols in the primary game are used as soft buttons to affect transposition of symbols from the primary game to the secondary game, and between symbol display positions in the secondary game; and (v) secondary game symbols persist to subsequent plays of the primary game to help the player to win at the secondary game.

DESCRIPTION OF THE DRAWINGS

The invention will be better understood upon reading the following Detailed Description in conjunction with the drawing in which.

DETAILED DESCRIPTION OF THE INVENTION

Figure 1:
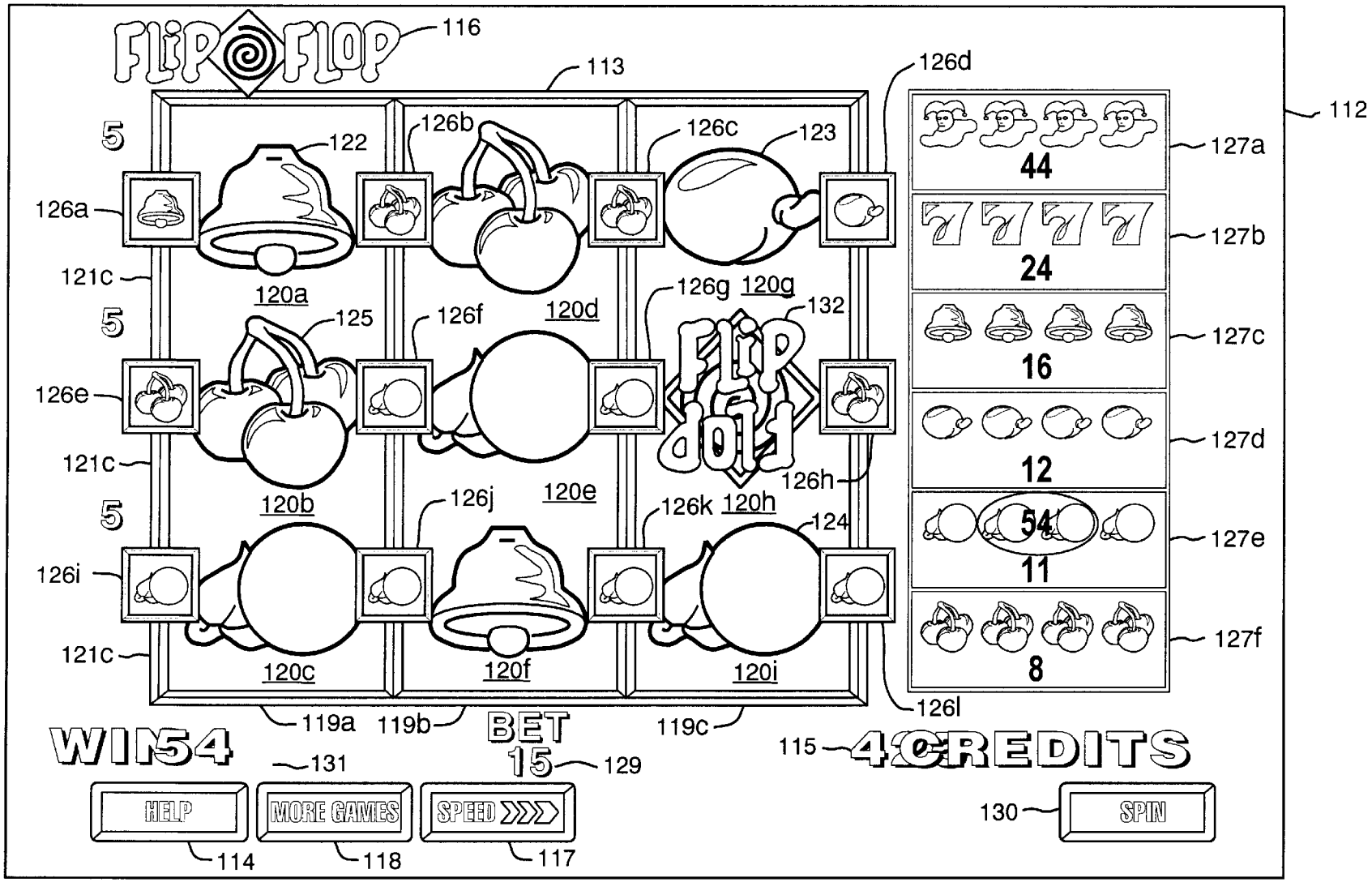
FIG. 1 shows the display screen of a first embodiment of my novel gaming apparatus having physically integrated primary and secondary games with the ability to transpose game symbols.

In FIG. 1 is shown the display screen of a first embodiment of my novel gaming apparatus having physically integrated primary and secondary games with the ability to transpose game symbols from one secondary game symbol display position to another secondary game symbol display position to change the odds of winning at the secondary game.

As depicted in FIG. 1, the present invention is implemented in a way which retains many of the features of present gaming devices. For example, the display screen 112 includes a playing field 113. Playing field 113 is the central region of the display which shows the game symbols involved in playing the game. Thus, in the depicted slot machine, which is the primary game embodiment of the present invention, the playing field 113 shows three vertical simulated slot machine reels 119*a*–119*c* and three pay lines 121*a*, 121*b* and 121*c*.

The display screen 112 may include other indicia, indicators, or touch screen regions such as a won credit indicator 115, a game logo 116; and various touch screen regions or "soft buttons" such as Help 114, Speed selector 117, Spin 130, and More Games 118 for selecting other games to be played. It is also possible to use other input devices for playing the game such as a button panel, keyboard, mouse, joystick, and the like, but these are not shown or described herein.

Display screen 112 utilizes touch screen technology, well known in the art, so that a player may operate the above mentioned soft buttons by touching the screen at the site of a soft button. Touch screen technology is also used when a player is manually making game decisions and touching primary game symbols on playing field 113 to affect game symbol transpositions in the secondary game in accordance with one feature of the invention.

In FIG. 1, playing field 113 depicts a simulation of the exposed portion of three game reels 119*a*, 119*b* and 119*c* of a slot machine which is the primary game of this embodiment of the invention. There are three pay lines 121*a*, 121*b* and 121*c* and the primary game can be won on any of the three pay lines if they are selected by a player to be played. Between three game reels 119*a*–119*c* and three pay lines 121*a*–121*c*, nine primary game positions are provided designated 120*a* through 120*i*. Other embodiments may provide more or fewer reels, and more or fewer pay lines. In a typical game, there is a winning outcome if any of a number of predetermined winning symbol combinations appear (e.g., three cherries, three oranges, two plums and a Joker, etc.) along any of pay lines 121*a*–121*c*. Electronic slot machines can alternatively be provided with different pay lines which are vertical or diagonal.

In the game embodiment depicted in FIG. 1, playing field 113 includes traditional game symbols associated with the primary game such as a bell 122, plum 123, orange 124, cherries 125, and so forth. The game symbol appearing in each of primary game display positions 120*a* through 120*i* on playing field 113 is random and has the potential to change in each play of the primary game. To implement the present invention there is also a special Flip-Flop symbol 132, shown in primary game position 120*h*, which may appear in any of primary game positions 120*a*–120*i* upon each play of the primary game, and may cause the transposition of adjacent secondary game symbols as described in greater detail hereinafter. This physical linking of the two games is a feature of the present invention.

In accordance with a feature of the present invention, a secondary game is provided which is physically integrated with the primary game. In FIG. 1 the secondary game has game symbol display positions designated 126*a*–126*l* that are located on either side of each of primary game display positions 120*a*–120*i*, as shown. In the secondary game positions 126*a*–126*l* are displayed the same traditional game symbols such as a bell 122, plum 123, orange 124, seven and Joker (both not shown), and cherries 125, but not the aforementioned special Flip-Flop symbol 132.

After each play of the primary game the game symbol appearing in each of the secondary game positions 126*a,e, i,d,h,l* along the far left and far right vertical edges of playing field 113 will automatically change to match the game symbols that appear in the adjacent one of primary game display positions 120*a,b,c,g,h,i* unless the symbol in one of these primary game display positions is the Flip-Flop symbol 132. This is done in accordance with one of the features of the invention wherein primary game symbols move to secondary game display positions. When the Flip-Flop symbol 132 appears in any of primary game positions 120*a–i* after each play of the primary game, the symbol appearing in horizontally adjacent ones of secondary game symbol display positions 126*a–l* will remain what they were before the spin, and will not change to a Flip-Flop symbol 132.

As seen in FIG. 1, bell 122 appears in primary game display position 120*a* and a bell also appears in secondary game display position 126*a*, cherries 125 appear in primary game display position 120*b* and cherries also appear in secondary game display position 126*e*, orange 124 appears in primary game display position 120*c* and an orange also appears in secondary game display position 126*i*, plum 123 appears in primary game display position 120*g* and a plum also appears in secondary game display position 126*d*, and orange 124 appears in primary game display position 120*i* and an orange also appears in secondary game display position 126*l*. The special Flip-Flop symbol 132 appears in primary game display position 120*h* so it does not appear in secondary game display position 126*h*. Rather, the cherries that appear in secondary game display position 126*h* remain there from the previous play of the game. The particular game symbol in each of secondary game positions 126*b,c, f,g,j,k* do not change except by transposition of game symbols between these secondary game positions as described below with reference to the function of the Flip-Flop symbol.

The purpose of the Flip-Flop primary game symbol 132 is to indicate that horizontally adjacent secondary game symbols may be transposed horizontally to improve the chance of the player winning in the secondary game. Having primary game symbols direct play of secondary game symbols is one of the features of the present invention. During each play of the primary game the Flip-Flop symbol 132 can only appear in one primary game position at a time of each of horizontal game reels 119*a,b,c*. When the Flip-Flop symbol 132 is displayed in one or more of primary game symbol positions 120*a*–120*i* as a result of a play of the primary game, Flip-Flop symbol 132 is first displayed, followed by the temporary display of a horizontal double headed arrow (not shown), and finally the Flip-Flop symbol 132 is again displayed in the primary game symbol position (s). The temporarily displayed horizontal arrow is an aid to the player to see the migration of secondary game symbols from the far right and far left edges of game field 113 toward the middle of each play line 121*a,b,c*; or between secondary game positions 126*b*&*c*, 126*f*&*g*, and 126*j*&*k*. These secondary game symbols persist on the playing field between multiple plays of the primary game in accordance with another of the features of my invention.

When a Flip-Flop symbol 132 appears as a result of a play of the primary game, such as it does in primary game position 120*h*, the game software determines if a transposition of secondary game symbols will increase the game player's odds of winning the secondary game and, if the odds will be increased, the appropriate secondary game symbols are automatically transposed. Thus, as shown in FIG. 1, the cherries in secondary game position 126*h* can be transposed with the orange in secondary game position 126*g*. While symbol transposition is automatically analyzed and accomplished in one embodiment of the invention, in an alternate embodiment of the game transpositions may be manually selected by the player touching the Flip-Flop symbol displayed on the display screen at primary game display position 120*h*. This is described in greater detail in the next paragraph.

While transposition of secondary game symbols, as described immediately above, is done automatically, the game may also be configured such that decisions to transpose the secondary game symbols are made manually to permit a player to exercise their "optimizing skills" in accordance with one of the features of my invention. When the manual operation is provided the system utilizes touch screen technology and the player may affect the transposition by either pressing a button (not shown) on the gaming unit located below the display screen 112 (not shown), and there is one button positioned below each of game reels 119*a,b,c*; or the touch screen technology can be utilized and the player touches a displayed Flip-Flop symbol 132 to affect the transposition of the secondary game symbols on either side of the Flip-Flop symbol 132. In this manual operation Flip-Flop symbols in the primary game are used as soft buttons to affect transposition of symbols in the secondary game, which is one of the features of the present invention.

Between spins or plays of the primary game the secondary game symbols remain in the secondary game positions 126*a*–126*l* except for automatic or manual secondary game symbol replacement/transpositions as described above. When a player achieves four alike secondary game symbols, which may include wild card Jokers, in one or more of pay lines 121*a*, 121*b* and 121*c*, there is a win or wins for the secondary game. The operation described for the secondary game provides persistence of secondary game symbols over many plays of the primary game in accordance with another feature of the invention.

While in the previous description primary and secondary games are played in all three pay lines 121*a*, 121*b* and 121*c*, in actuality a player must decide before the start of a play of the primary game if he or she is going to play one, two or all three of pay lines 121*a*–121*c*.

When the player inserts a first coin or token into a slot (not shown) on the front of the game machine, or they use one of their credits (shown displayed at 115), he or she will be playing only pay line 121*b* and the number "1" will appear to the left of secondary game display position 126*e*. When the player inserts a second coin or token into the slot, or uses another of their credits, they will also be playing pay line 121*a* and the number "1" will appear to the left of secondary game display position 126*a*. When the player inserts a third coin or token into the slot, or uses another of their credits, they will also be playing pay line 121*c* and the number "1" will appear to the left of secondary game display position 126*i*. As the player inserts a fourth coin or token into the slot, or uses another of their credits, they will be placing a second bet on pay line 121*b* and the number "2" will appear to the left of secondary game display position 126*e*. When the player inserts a fifth coin or token into the slot, or uses another of their credits, they will be placing a second bet on pay line 121 a and the number "2" will appear to the left of secondary game display position 126*a*. Similarly, the insertion of a sixth coin or token into the slot, or use of another credit, will increment the bet on pay line 121*c* and the number "2" will appear to the left of secondary game display position 126*i*. The deposit of additional coins or tokens into the slot, or the use of credits, will continue to increment the bets on pay lines 121*a*–121*c* in the sequence described above.

In FIG. 1 the number 5 is displayed adjacent to secondary game symbol positions 126*a,e,i* indicating that five coins, tokens or credits have been bet on each of pay lines 121*a*–121*c*. The total of the coins, tokens or credits bet on pay lines 121*a*–121*c* in FIG. 1 is fifteen which is indicated by the "Bet 15" indication 129 above Speed soft button 117.

If a player is only playing one or two of play lines 121*a*–121*c*, and a winning combination of game symbols appears on a pay line that is not being played, the player does not win on that the non-played.

If a player wins a primary game on one of pay lines 121*a*–121*c* they will win a number of credits determined in a manner well known in the gaming art. However, the number in front of pay lines 121*a*–121*c*, reflecting the amount of the bet on the pay line, acts as a multiplier to the winnings. With the number five next to all pay lines as shown in FIG. 1 and as described above, if the player would have won twelve credits upon winning a primary game on one of pay lines 121*a*–121*c*, the multiplier of five means that they will instead win sixty credits. It is to be understood that the multiplier number in front of pay lines 121*a*–121*c* only applies to the primary games and not to the secondary games. The number of credits won from a primary game will increment the total credits shown at position 115.

The amount of credits that a player gets when winning a secondary game depends upon the value associated with the secondary game progressives 127*a*–127*f* at the right side of display screen 112, and the value is the number inside each of secondary game progressives 127*a*–127*f*. These payout values change over successive plays of the primary game. With the secondary game progressives shown in 127*a*–127*f*, if the player wins a secondary game with four bells, or a combination of bells and wild cards (Joker), the player wins sixteen credits as indicated by the number sixteen inside secondary game progressive 127*c*. The game symbols displayed in each of secondary game progressives 127*a*–127*f* are Joker 127*a*, Seven 127*b*, Bell 127*c*, Lemon 127*d*, Orange 127*e*, and Cherries 127*f* and the particular symbol does not change.

After a player wins at the secondary game, the one of pay lines 121*a*–121*c* in which the win took place will have the game symbols displayed in the two middle most secondary game positions removed at the start of the next play of the primary game. For pay line 121*a*, secondary game positions 126*b*&*c* would be blank. For pay line 121*b*, secondary game positions 126*f*&*g* would be blank. For pay line 121*c*, secondary game positions 126*j*&*k* would be blank. Those spaces will remain blank until a Flip-Flop symbol 132 appearing in ones of primary game positions 120*a,b,c,g,h,i* results in automatic or manual transposition of a secondary game symbol into the blank positions from ones of secondary game positions 126*a,e,i,d,h,l*. Such symbol transposition has been previously described.

The total amount of a player's winnings over a number of plays of the primary and secondary games is shown at the lower right of display screen 112 at position 115. As shown in FIG. 1 a player has total winnings of 425 credits.

At the bottom of display screen 112 are soft (touch screen) buttons. Help button 114 may be used to get help about how to play a game. The More Games button 118 is touched to cycle the machine to other games such as the alternative embodiment of my novel game disclosed further in this Detailed Description with reference to FIGS. 2 and 3. The Speed button 117 may be touched to alternately speed up or slow down the rate at which a game is played. Spin button 130 is touched after coins or tokens have been inserted into the unit, or credits decremented, to start the next play of the primary game. When a player is done playing and wants to collect their winnings, they push a button (not shown) on the front panel of the gaming machine. The winnings may be paid out as tokens, coins or credits. Credits are used to increment a credit total on a magnetic card issued to the player and inserted into a card slot (not shown) on the game machine.

Figure 2:
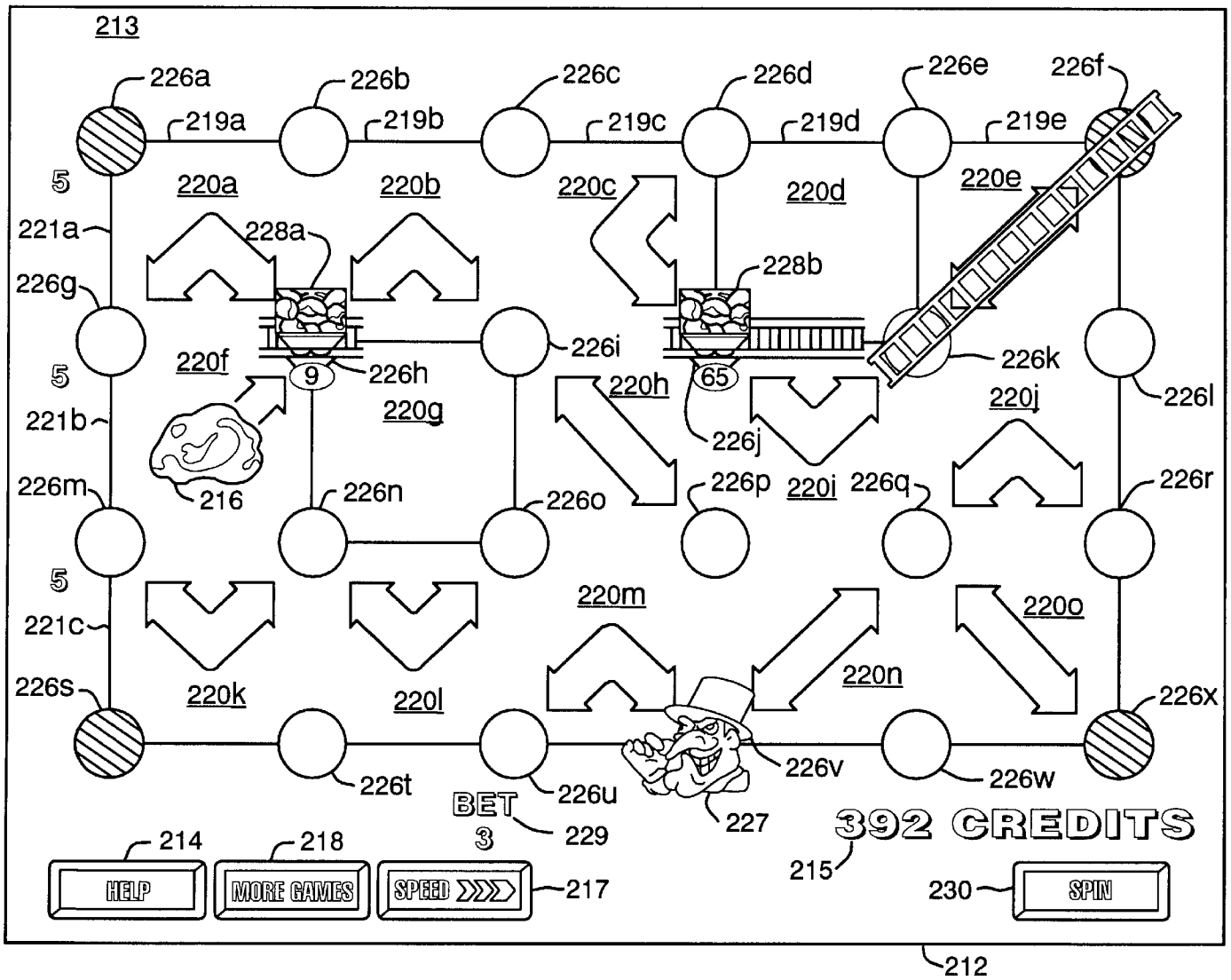
FIG. 2 shows the display screen of a second embodiment of my novel gaming apparatus having physically integrated primary and secondary games with the ability to transpose game symbols.

In FIG. 2 is shown the display screen of a second embodiment of my novel gaming apparatus having all the above listed features of the present invention.

As depicted in FIG. 2, there is a display screen 212 having a playing field 213. Display screen 212 has displayed thereon game symbols and other indicia and indicators such as credit indicator 215 and field 229 indicating the total amount bet on each play of the game. There are also various touch screen regions or "soft buttons" such as Help button 214, Speed selector 217, Spin button 230, and More Games 218 for selecting other games to be played. The function of these soft buttons has already been described with reference to the embodiment of my invention shown in FIG. 1. In addition, in accordance with a feature of the invention, game symbols may also be used as soft buttons to implement manual decisions that affect secondary game play. Other input devices such as a button panel, keyboard, mouse, joystick, a magnetic card reader and writer, and the like, may be used but these are not shown or described here because they are well known in the art.

Playing field 213 depicts a simulation of the exposed portion of five vertical game reels 219*a* through 219*e*. There are also three pay lines designated 221*a*–221*c*. Between the five reels and three pay lines fifteen primary game positions are provided designated 220*a* through 220*o*. Other embodiments of the invention may provide more or fewer reels, paylines and more or fewer exposed symbols per reel.

The primary game primarily utilizes non-traditional symbols which are the double headed arrows of different shapes as shown in some of primary game positions 220*a*–220*o*. The arrows may also have more than two points in variants of this embodiment of the invention. There is another non-traditional game symbol, gold nugget 216, which is shown in primary game position 220*f*. Each gold nugget 216 symbol that appears on playing field 213 will have an arrow adjacent to it that points to one of the four secondary game positions about the primary game position in which nugget 216 is displayed. In FIG. 2, nugget 216 in primary game position 220*f* has an arrow that points to secondary game position 226*h*. The purpose of the gold nuggets and their arrow is described hereinafter.

In the primary game, there is a winning outcome if five identical arrows appear in the primary game positions 220*a*–220*o* of any of pay lines 221*a*–221*c*. Alternatively, the game may be changed so that a win will be accomplished with fewer identical arrow symbols, or with different pay lines which are oriented vertically or diagonally. The winning symbol combinations and the amounts to be paid are indicated in a pay table as is well known in the art.

The game symbols appearing in each of the primary game positions 220*a*–220*o* of playing field 213 is random and will usually change for each play of the primary game.

In this second embodiment of the invention a secondary game is provided which is integrated with the primary game per the teaching of the invention. In FIG. 2 the secondary game has secondary game display positions designated 226*a*–226*x* which are located in a matrix as to have four secondary game display positions about each of primary game display positions 220*a*–220*o*, as shown. One game symbol that is used exclusively in the secondary game are ore cars 228 such as cars 228*a*&*b* shown respectively in secondary game positions 226*h* and 226*j*. At the start of game play there will initially be no ore car symbols on any of secondary game positions 226*a*–226*x*, but there will be ore cars, such as 228*a* and 228*b*, created over a number of plays of the primary game. Ore cars 228 are only created when a gold nugget symbol 216 appears in a primary game position 220*a*–220*o* after a play of the primary game, and there is no ore car 228 in the one of the secondary game positions to which the arrow adjacent to nugget 216 points to. When an ore car 228 is created the gold nugget moves from the primary game display position to the new ore car 228. This is a feature of the invention wherein primary game symbols direct the play at secondary game display positions. For example, in FIG. 2, if there were no ore car 228*a* in secondary game position 226*h* and, as a result of a play of the primary game, nugget 216 appears in primary game position 220*f* (as shown) with its arrow pointing to secondary game position 226*h*, ore car 228*a* would then appear in secondary game position 226*h*. The nugget will move to the newly created ore car 228 and the number "1" will appear beneath the ore car indicating that there is only one gold nugget 216 in the ore car 228.

If an ore car 228*a* already exists in secondary game position 226*h* (as actually shown in FIG. 2), an ore car is not created, but a number associated with ore car 228*a* is incremented by one to reflect the number of gold nuggets deposited in the ore car during multiple plays of the game. This is discussed in greater detail further in this specification, but in FIG. 2 is shown as the number "9" displayed below ore car 228*a* and the number "65" displayed below ore car 228*b*. Thus, there are nine gold nuggets in ore car 228*a* and sixty-five gold nuggets in ore car 228*b*.

After each spin or play of the primary game, the multi-headed arrows appearing in ones of primary game positions 220*a*–220*o* impact the action in the secondary game because they control the possible movement of any displayed ore cars 228 between secondary game positions 226*a*–226*x*. It should be noted that unlike the first embodiment of the game (shown in FIG. 1) wherein transpositions can only occur along horizontal pay lines, in this embodiment of the invention movement of ore cars 228 takes place between secondary game positions 226*a*–226*x* in all directions as indicated by the multi-headed arrows in ones of primary game positions 220*a*–220*o*. This is the main physical integration of the primary and secondary games in this second embodiment of the invention shown in FIG. 2. This is a feature of the invention where primary symbols direct play options of secondary game symbols.

Figure 3:
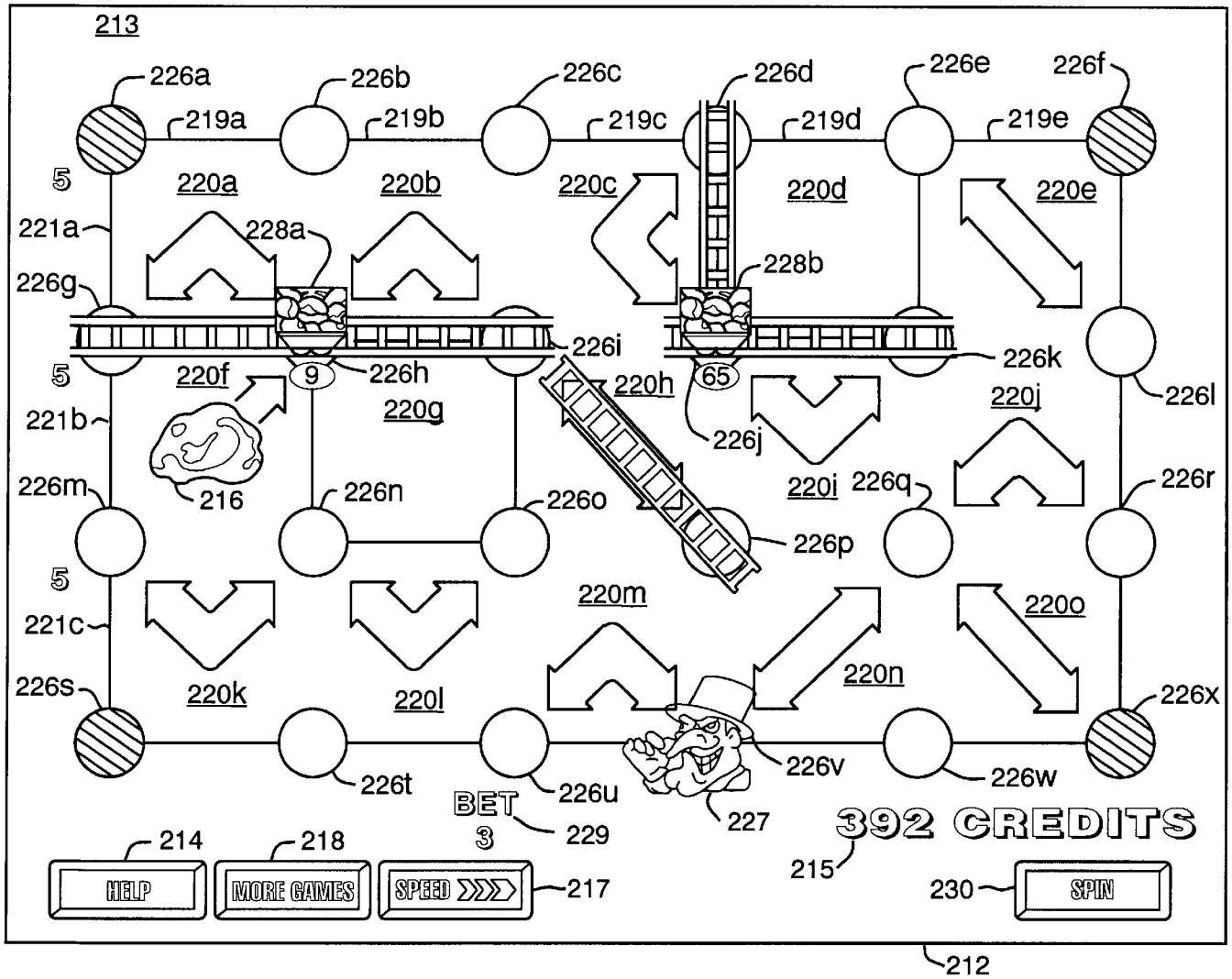
FIG. 3 shows another display screen of the second embodiment of my novel gaming apparatus after the game reaches its idle state.
Figure 4:
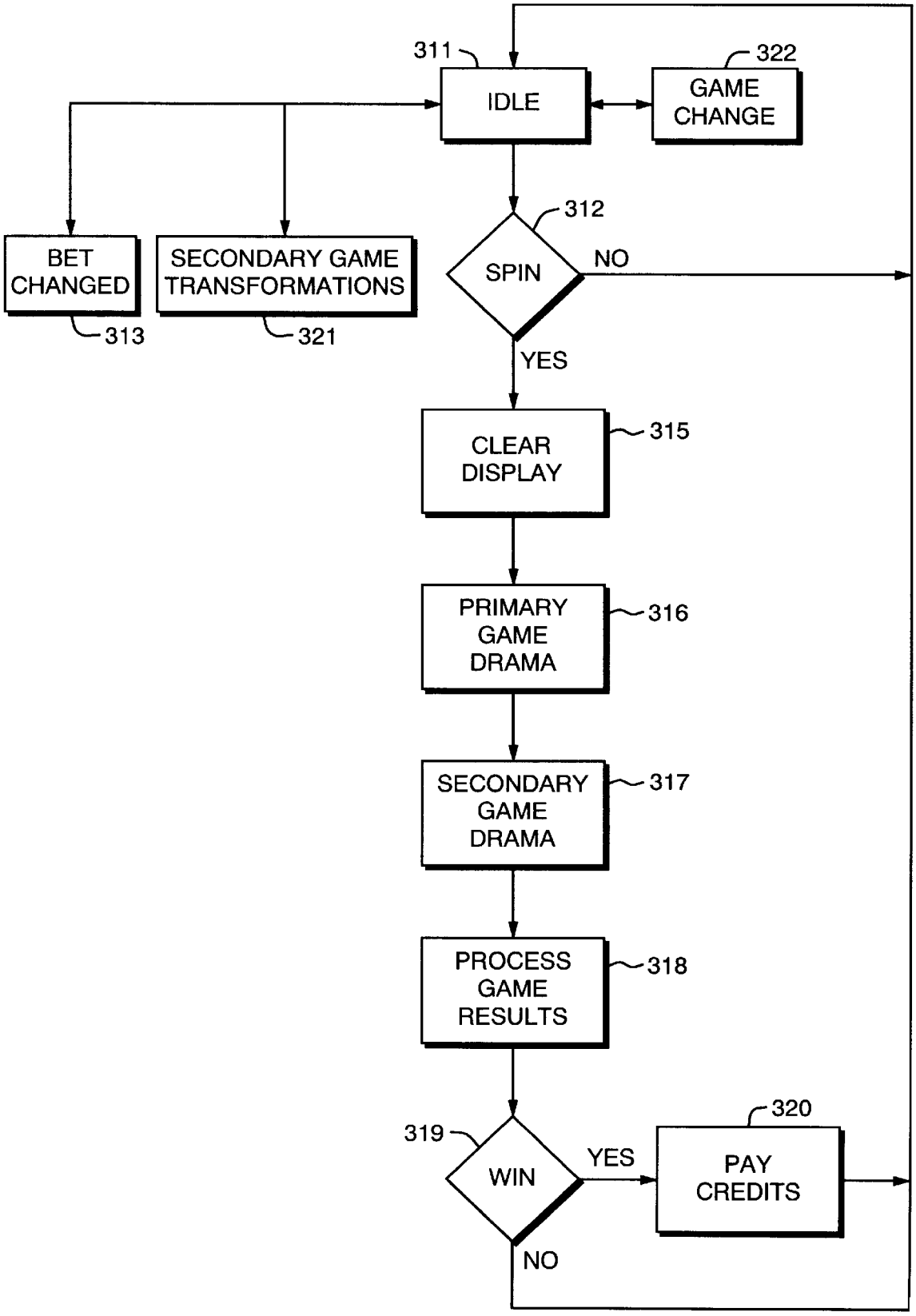
FIG. 4 is a flow chart depicting the logic involved in the gaming software for playing a game that includes a primary game and physically integrated secondary game according to the teaching of the present invention.

In the Secondary Game Drama block 317 in FIG. 4 the game software first automatically checks to see if there are any ore cars 228 that can be moved to one of "safe" secondary game corner positions 226*a*, 226*f*, 226*s* and 226*x*. When an ore car 228 reaches one of these four "safe" corner positions its contents are "won" by the player, and the player's game credits indicated at position 215 are incremented by the indicated number of gold nuggets in the ore car. This movement of ore cars is made to best protect the gold nuggets in the ore cars 228 from a villain symbol 227 shown in secondary game position 226*v*. This operation is described further in this Detailed Description with reference to FIG. 3.

In FIG. 2 the automatic check to see if there are any ore cars 228 that can be moved to one of secondary game corner positions 226*a*, 226*f*, 226*s* and 226*x* determines that there are arrows in each of primary game positions 220*i* and 220*e* that create a chain of arrows to "safe" corner position 226*f*. More particularly, in FIG. 2 there is an arrow in primary game position 220*i* pointing to secondary game display positions 226*j* and 226*k*, and there is an arrow in primary game display position 220*e* pointing to secondary game display positions 226*k* and 226*f*. Position 226*f* is a "safe" corner position so track segments are displayed between secondary game display positions 226*j*, 226*k* and 226*f*. The game then automatically moves ore car 228*b* to "safe" corner position 226*f* where the player receives the contents of ore car 228*b*. The contents are indicated as being sixty-five gold nuggets, as indicated by the number 65 beneath ore car 228*b*. The players credits at field 215 are incremented by the number sixty-five. Ore car 228*b* will also disappear from playing field 213.

On the other hand ore car 228*a* on secondary game display position 226*h* cannot be moved to a "safe" corner position because there are not enough arrows in primary games positions chained together to reach corner secondary game position 226*a* or any other corner position. Therefore, no tracks are displayed to adjacent secondary game positions after the completion of the present play of the primary game.

Following the automatic movement of any ore cars to "safe" corner secondary game positions the display of tracks leading to such corner positions are removed from the display. The player then gets to manually determine the move of any ore cars remaining on playing field 213 as described with reference to FIG. 3.

In FIG. 3 is basically shown the same playing field 213 as is shown in FIG. 2. The only difference is that the arrow displayed in primary game position 220*e* is rotated ninety degrees. With the arrow in position 220*e* oriented in this manner ore car 228*b* cannot be automatically moved to corner secondary game position 226*f* as described in previous paragraphs.

Villain symbol 227 only moves after the automatic ore car moves have been made, but before the manual moves have been made, all as described in the previous paragraphs. More particularly, villain 227 is moved at the end of Secondary Game Drama block 317 in FIG. 4. Villain 227 can only move to an adjacent secondary game display position, and only if there is an arrow linking the secondary game position on which villain 227 is displayed and to the adjacent secondary game display position. In FIG. 2 villain 227 is shown in secondary game symbol position 226*v*. Per the double headed arrows in primary game display positions 220*m* and 220*n*, villain 227 can only move to either secondary game positions 226*u* or 226*q*. If villain 227 moves to a secondary game position on which is located an ore car 228, other than the four corner secondary game positions 226*a,f,s,x*, the player loses all the gold nuggets in the ore car and the ore car symbol disappears. Alternatively, villain 227 may only take a portion of the gold nuggets in an ore car.

Just after the automatic movement of any ore cars 228 to "safe" comer secondary game positions the game determines to what positions any ore cars (228*a* and 228*b*) remaining on playing field 213 may be manually moved by the player and indicates the possibilities with displayed track segments. These manual decisions are made by the player to best protect the gold nuggets in the remaining ore cars 228*a*&*b* from villain 227 shown in secondary game position 226*v*. This is accomplished during in Idle State block 311 in FIG. 4.

In FIG. 3 these track segments are shown between secondary game positions 226*g*, 226*h*, 226*i* and 226*p*; and between secondary game positions 226*d*, 262*j* and 226*k*. The display of any track segments at this time is determined by the arrows in primary game positions as previously described. More particularly, for ore car 228*a* there is an arrow in primary game position 220*a* pointing to secondary game display positions 226*g* and 226*h*, an arrow in primary game display position 220*b* pointing to secondary game display positions 226*h* and 226*i*, and an arrow in primary game display position 220*h* pointing to secondary game positions 226*i* and 226*p*. For ore car 228*b* there is an arrow in primary game display position 220*c* pointing to secondary game display positions 226*d* and 226*j*, and an arrow in primary game display position 220*i* pointing to secondary game positions 226*j* and 226*k*.

With reference to FIG. 3, the player decides where to move remaining ore cars 228*a* and 228*b*. To move ore car 228*a* from secondary game position 226*h* to 226*g* the player will touch the arrow in primary game display position 220*a*. To move ore car 228*a* from secondary game display position 226*h* to position 226i the player will touch the arrow in primary game position 220*b*. The player can continue to move ore car 228*a* on to subsequent secondary game display position 226*p* by next touching the arrow in primary game position 220*h*. As previously described touch screen technology is used in a manner well known in the art. This is in accordance with a feature of the invention where symbols in the primary game are used as soft buttons to affect transposition of symbols in the secondary game.

In a variation of the second embodiment of the invention disclosed herein, which variation is not shown in any of the drawings, the double headed arrows shown in primary game positions 220*a*–220*o* in FIG. 2 are replaced by a set of primary game symbols which include traditional symbols such as cherries and sevens, but also include other symbols such as pick and shovel, donkey, and ore car. The primary game will be won in the same manner as described with reference to FIG. 2. Such traditional symbols will increase the player's interest in the primary game. The placement of track segments between secondary game positions 226*a*–226*x* is responsive to primary game symbol arrows displayed in primary game positions 220*a*–220*o*. However, not all track segments are displayed. Track segments that have no chance of being used are not displayed. Finally, the villain symbol 227 displayed in a secondary game position is able to move from one secondary game position to another secondary game position, not responsive to an arrow symbol displayed in an adjacent primary game position, but responsive to a snake symbol being displayed in a primary game position adjacent to villain symbol 227. The head or tail of the snake symbol may point to villain 227 and the villain may only move to the secondary game position at the opposite end of the snake.

In FIG. 4 is depicted a programming flow chart of my novel games. A game initially is in an Idle state 311 awaiting a game to be selected at Game Change block 322, and/or the deposit of coins, tokens, or the insertion of a magnetic card or ticket into a receptor slot, and used to indicate a number of credits to be bet on a game at Bet Changed block 313.

Periodically the software checks for a new game to be selected at Game Change block 322 by a player touching More Games soft button 118 or 218 (see FIGS. 1 and 2) and selecting a new game from a game list that is then displayed. If a new game is selected by the player, the game playing field for the newly selected game is displayed. The listed games may include the games in FIGS. 1 and 2. If a new game is not selected the game playing field being displayed is not changed. In addition, the game software periodically checks for the player to touch Help soft button 114 or 214 (see FIGS. 1 and 2) for the selected game being displayed. If the player requests help, a help screen is displayed on display field 112, 212 in lieu of the chosen game. On the help screen are some additional soft button used by the player to scroll through the help information and to return to the selected game.

The game software also periodically checks at Bet Changed block 313 to see if a player has deposited coins or tokens, or has insert a magnetic card or ticket having game credits indicated thereon and has indicated a number of credits to be bet on the chosen game. If no bet indication is detected the game software cycles back to Idle block 311. When the game software detects that coins or tokens have been inserted, or a magnetic card or ticket has been inserted into a card receptor slot (not shown) it waits for the completion of the bet. The program stores the information and displays the pay line bets and total bets at Bet 132, 227 on the display screen of the chosen game as shown in FIGS. 1, 2 and 3. In addition, if the player has used credits won from previously played games, the number of credits displayed at 115 in FIG. 1, or at 215 in FIGS. 2 and 3, are decremented by the number of credits bet on the game round to be played. In the example of FIG. 1, the player has bet 15 credits and the number of won credits at 115 are decremented to 425 credits.

After a player has placed their bets, Spin soft button 130 in FIG. 1 or Spin button 230 in FIG. 2 is touched to initiate a play of the chosen game. Responsive thereto the game knows that no more bets will be placed and progresses to Clear Display block 315. At this point the game clears the Win indications, if any, displayed from the previous game. For the game shown in FIGS. 2 and 3 this would also include removing the tracks displayed between secondary game positions. In an alternative embodiment of the invention, described elsewhere in this detailed description, the tracks are left in place.

After the display has been cleared at Clear Display 315, the game software progresses to Primary Game Drama block 316 where the primary game symbols to be displayed for the next round of play of the chosen game are determined and displayed in primary game positions 120*a*–120*i* for the Flip-Flop game, and in positions 220*a*–220*o* for the Villain game. For the type of games shown in FIGS. 1 and 2 the display would include the vertical rolling of primary game symbols in game reels 119*a*–119*c* (FIG. 1) and 219*a*–219*e* (FIG. 2) in a manner well known for "one armed bandit" type games. The animation may be accompanied by appropriate sound effects.

The next step in the sequence of the game is Secondary Game Drama 317. For the game shown in FIG. 1 the game software displays primary game symbols being moved to secondary game positions 126*a,e,i,d,h,l*, and updates the win tables displayed in secondary game progressives 127*a*–127*f*. All these operations are described in detail elsewhere in this specification. For the game shown in FIGS. 2 and 3 the game creates ore cars 228 or increments the number of gold nuggets in ore cars 228 as necessary, displays tracks, moves ore cars, and moves villain 227. Regarding moving the ore cars, the game software automatically checks to see if there are any ore cars 228 that can be moved to one of "safe" secondary game corner positions 226*a*, 226*f*, 226*s* and 226*x*. When an ore car 228 reaches one of these four "safe" corner positions its contents are "won" by the player. In FIG. 2, ore car 228*b* may be moved from secondary game position 226*j* to safe corner position 226*f*. All these operations are described in detail elsewhere in this specification. The animation may be accompanied by appropriate sound effects.

If in the game shown in FIGS. 2 and 3 villain 227 has moved to a secondary game position whereon there is an ore car 228, the ore car disappears and its gold nuggets are lost, or at least diminished in number.

The next step in the game is at Process Game Results block 318. The game checks primary game results at paid ones of pay lines 121*a*–121*c* for the Flip-Flop game shown in FIG. 1, and at paid ones of pay lines 221*a*–221*c* for the villain game shown in FIGS. 2 and 3 to determine if there has been a win at any of the primary games. Winnings are calculated in a manner well known in the art, and include multiplying game winnings by the number of bets placed on a winning pay line. In addition, the game checks secondary game results to determine if there has been a win at any of the secondary games of FIGS. 1 and 2. When there is a win at the secondary game in FIG. 1 the secondary game progressives 127*a*–127*f* are used to determine the amount won by the player. For the game shown in FIGS. 2 and 3 this would be determining if an ore car 228 has been moved to a safe corner secondary game position 226*a,f,s,x*. The winnings are the number of gold nuggets (credits) in the ore car.

The game software then moves to Win decision block 319. If there has been no win at the primary or secondary game, the game returns to Idle block 311 to await the player either playing another round of the chosen game, selecting and playing another game, or touching the Game Over button and collecting any credits they have won (115, 215). If there has been a win in the primary or secondary game, the game software goes to Pay Credits block 320 where the previously calculated number of credits won are paid as shown at 115 in FIG. 1 and at 215 in FIG. 2. The game then returns to Idle block 311.

In the Secondary Game Transformations block 321 in FIG. 4, player decided game symbol moves are accomplished. As mentioned previously, a player may decide and make game symbol moves for the games in FIGS. 1 and 2 using the touch screen capability provided with the game hardware. If, after a round of play of the game in FIG. 1, a player uses the touch screen operation to indicate flip-flop moves of game symbols between secondary game positions on either side of a displayed Flip-Flop symbol 132, such as at secondary game positions 126*g* and 126*h*, the secondary game symbol transposition is accomplished. If, after a round of play of the game in FIGS. 2 and 3, a player uses the touch screen operation to indicate manual moves of ore cars 228 to either keep them away from villain 227, or to move the ore cars closer to a safe corner position 226*a,f,s,x*.

In addition, if the gaming is ended by the player as determined by touching a Cash Out button (not shown in FIG. 1) on the front panel of the gaming equipment, the program causes the payout of the player's credits. This may be by dispensing coins or tokens, or by incrementing the amount of credits on a magnetic card or ticket the player has in their possession and inserts into a slot (not shown) on the front of the game machine.

The game continues only when the player places another bet by depositing coins or tokens, by using credits on a magnetic card or ticket the player has in their possession and inserts into a slot (not shown) on the front of the game machine, or by placing a bet using credits the player has already won and which are displayed on the game field. This operation is as previously described.

The present invention can be implemented using a variety of different apparatus.

Figure 5:
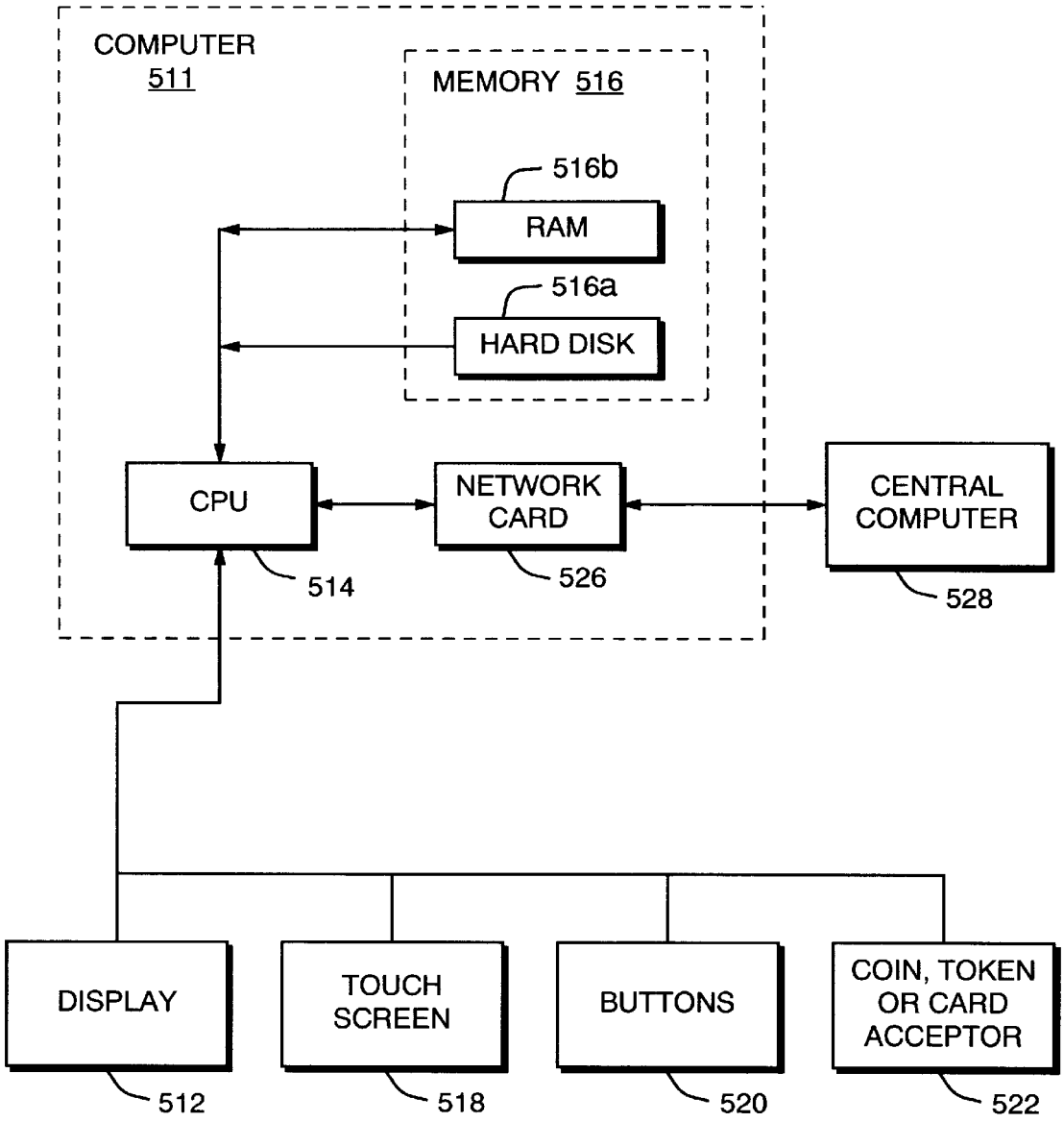
FIG. 5 shows a block diagram depicting a processor-based system used in implementing the present invention.

Preferably, the invention is implemented as shown in FIG. 5 using a computer 511 to determine game operation as shown in FIGS. 1, 2 and 3. In the embodiment of FIG. 5 the computer 511 includes a central processing unit (CPU) 514 connected to a memory 516. The computer 511 has connected thereto other devices such as display screen 512, a touch screen input device 518, one or more front panel buttons 520 (not shown) that are not the soft buttons previously described but which are used in the operation of the machine; a coin, token, or card acceptor 522 for allowing a player to place bets; and a network card 526 for connecting computer 511 to a central computer 528. The central computer 528 may be used for accounting, bookkeeping, and/or security purposes, or for downloading new game software or game software upgrades to computer 511, and/or for controlling the operation of the game via a network.

In the depicted embodiment, computer 511 includes a memory 516. Memory 516 has a more permanent first portion 516a in which is stored the software for running games on CPU 514, such as the games shown in FIGS. 1, 2 and 3. This memory 516*a* may be a hard disk (not shown), read only memory (ROM)(not shown), erasable programmable read only memory (EPROM)(not shown), an application specific integrated circuit (ASIC)(not shown). All these integrated circuit storage means are well known in the art so are not discussed further. The advantage to providing all game logic via a stored program on hard disk, or via network card 526 from central computer 528, is that a game may quickly and easily be updated, or a different game program be loaded to run on the computer without having to change any integrated circuit chips, such as the ROMs, EPROMs or ASICs.

When game software remains on central computer 528 it permits games to be played over a local network, or over a remote network which may include the Internet.

Memory 516 also has a second portion 516*b* used in playing the games. The memory 516*b* is typically random access memory (RAM) has memory locations associated with each of the primary game positions, secondary game positions, secondary game progressives, information display areas and soft buttons on display 112 of FIG. 1 and display 212 of FIGS. 2 and 3. These memory locations store information about the game symbols displayed, the bets placed, winnings, the speed of the game, etceteras.

Alternatively, individual game software may not be permanently stored in memory 516*b*. When a player touches the More Games soft button 118 of FIG. 1 or 218 of FIGS. 2 and 3 and selects a game, the request may be transmitted via network card 526 to central computer 528 and the game software is downloaded to memory 516*a* to be used by CPU 514 to run the game chosen by the player. This permits central control of the games to be played on specific machines, fast upgrades of game software and easier addition of software for new games.

While what has been disclosed in this detailed specification is the preferred embodiment of the invention it will be obvious to those skilled in the art that numerous changes may be made without departing from the scope of the invention.

What is claimed is:

1. Apparatus for a player to play a series of rounds of a first game and a series of rounds of a second game that is physically integrated with said first game, with the goal being to win at both of said games, said apparatus comprising:

a display device;

a computer coupled to said display device and programmed to display a game field thereon showing game action for both said first game and said second game at the same time;

said computer displaying on said game field on said display device a first plurality of game symbols for playing a series of rounds of said first game; and said computer further displaying on said game field on said display device a second plurality of game symbols for playing said second game, and game action in either said first or said second game affects game action in the other of said games.

2. The invention in accordance with claim 1 wherein after each round of said first game said computer moves some of said first plurality of game symbols to said secondary game where they are displayed as secondary game symbols.

3. The invention in accordance with claim 1 wherein after each round of said first game said computer changes the positions in which said secondary game symbols are displayed on said game field to change the odds of winning at said second game.

4. The invention in accordance with claim 1 wherein some of said second plurality of game symbols persist on said game field from one round of play of said first game to other rounds of play of said first game, and said second game may be won over a plurality of rounds of play of said first game.

5. The invention in accordance with claim 4 wherein after each round of said first game said computer changes the positions in which said secondary game symbols are displayed on said game field to change the odds of winning at said second game.

6. The invention in accordance with claim 1 further comprising:

means for providing touch screen operation to said display device, said computer cooperating with said touch screen means to determine where the player touches said game field on said display device to indicate to said computer particular game actions to be taken by said computer.

7. The invention in accordance with claim 6 wherein said computer is responsive to said player using said touch screen means to move ones of said secondary game symbols from one position on said display device to another position on said display device to change the odds of winning at said second game.

8. The invention in accordance with claim 6 wherein said computer is responsive to said player using said touch screen means to indicate to said computer which of said first plurality of game symbols is to be moved from said first game to said second game to be displayed as second game symbols to change the odds of winning at said second game.

9. A method for a player to play a series of rounds of a first game and a series of rounds of a second game that is physically integrated with said first game, and said player can win at both of said games, said method comprising the steps of:

displaying a game field on a display device for playing both said first game and said second game at the same time, said game field having a first plurality of symbol display positions and a second plurality of symbol display positions to show game action for both said games;

displaying a first plurality of symbols in said first plurality of symbol display positions for playing said first game;

displaying a second plurality of symbols in said second plurality of symbol display positions for playing said second game; and changing the display of symbols in said second game depending on the display of symbols in said first game to change the odds of winning said second game.

10. The method in accordance with claim 9 wherein said step of changing the display of symbols in said second game as a result of the display of symbols in said first game comprises:

moving ones of said first plurality of game symbols from ones of said first plurality of game symbol display positions to ones of said second plurality of game symbol display positions where they are displayed as secondary game symbols to change the odds of winning at said second game.

11. The method in accordance with claim 9 wherein said step of changing the display of symbols in said second game as a result of the display of symbols in said first game comprises:

moving ones of said second plurality of game symbols from ones of said second plurality of game symbol display positions to others of said second plurality of game symbol display positions to change the odds of winning at said second game.

12. The method in accordance with claim 9 further comprising the step of maintaining the display of said second plurality of symbols on said game field while the player plays a series of rounds of said first game, with certain combinations of said first plurality of symbols indicating when said player achieves winnings from said first game, and with certain combinations of said second symbols indicating when said player achieves winnings from said secondary game.

13. The method in accordance with claim 12 wherein said first plurality of game symbols include a first special game symbol and further comprising the step of moving ones of said second plurality of game symbols from ones of said second plurality of game symbol display positions to others of said second plurality of game symbol display positions responsive to said first special game symbol to change the odds of winning at said second game.

14. The method in accordance with claim 12 wherein said first plurality of game symbols includes a first special game symbol and further comprising the step of moving ones of said first plurality of game symbols from ones of said first plurality of game symbol display positions to ones of said second plurality of game symbol display positions responsive to said first special game symbol to change the odds of winning at said second game.

15. The method in accordance with claim 13 wherein the player touches ones of said first plurality of game symbol display positions in which said first special game symbol is displayed to indicate to said computer to move ones of said second plurality of game symbols from ones of said second plurality of game symbol display positions to others of said second plurality of game symbol display positions to change the odds of winning at said second game.

16. The method in accordance with claim 14 wherein the player touches ones of said first plurality of game symbol display positions in which said first special game symbol is displayed to indicate to said computer to move said touched ones of said first plurality of game symbols from ones of said first plurality of game symbol display positions to ones of said second plurality of game symbol display positions to be displayed as a secondary game symbol and thereby change the odds of winning at said second game.

17. The method in accordance with claim 14 wherein the player touches ones of said first plurality of game symbol display positions in which said first special game symbol is displayed to indicate to said computer which of said first plurality of game symbols is to be moved from ones of said first plurality of game symbol display positions to ones of said second plurality of game symbol display positions to be displayed as secondary game symbols to change the odds of winning at said second game.

18. The method in accordance with claim 15 wherein the player touches ones of said first plurality of game symbol display positions in which said first special game symbol is displayed to indicate to said computer which of said second plurality of game symbols is to be moved from ones of said second plurality of game symbol display positions to others of said second plurality of game symbol display positions to change the odds of winning at said second game.

19. Apparatus for a player to play a series of rounds of a first game and a series of rounds of a second game that is physically integrated with said first game, with the goal being to win at both of said games, said apparatus comprising:

a display device;

a computer coupled to said display device and programmed to display a game field on said display device for playing both said first game and said second game at the same time;

said computer displaying on said game field on said display device a first plurality of game symbols for playing a series of rounds of said first game; and said computer displaying on said game field on said display device a second plurality of game symbols for playing said second game, with the choice of ones of said second plurality of game symbols being displayed on said game field for said second game being dependent on the ones of said first plurality of game symbols being displayed on said game field for said first game.

20. The invention in accordance with claim 19 wherein said computer causes the display of said second plurality of game symbols to persist on said game field from one round of play of said first game to other rounds of play of said first game, and said second game may be won over a plurality of rounds of play of said first game.

21. The invention in accordance with claim 19 further comprising:

means for providing touch screen operation to said display device, said computer being responsive to said touch screen means to determine which first game symbols the player touches said game field on said display device to indicate to said computer actions to be taken with regards to said second plurality of game symbols.

22. The invention in accordance with claim 21 wherein said computer is responsive to said touch screen means when the player touches first game symbols on said game field on said display device to change the position where ones of said second game symbols are displayed to change the odds of winning at said second game.

23. The invention in accordance with claim 19 wherein said computer is responsive to the ones of said first plurality of game symbols being displayed on said game field for said first game to move ones of said first game symbols from said first game to said second game to change the odds of winning at said second game.

24. The invention in accordance with claim 19 wherein said computer is responsive to the ones of said first plurality of game symbols being displayed on said game field for said first game to change the position where ones of said secondary game symbols are displayed on said game field to change the odds of winning at said second game.

25. A method for a player to play a series of rounds of a first game and a second game that is physically integrated with said first game, with the goal being to win at both of said games, said method comprising the steps of:

displaying a game field on a display device for playing both said first game and said second game at the same time, said game field having a first plurality of game symbol display positions for said first game and a second plurality of game symbol display positions for said second game;

displaying ones of a first plurality of game symbols on ones of said first plurality of game symbol display positions of said game field for playing a series of rounds of said first game; and displaying ones of a second plurality of game symbols on ones of said second plurality of game symbol display positions on said game field for playing said second game, and which of said second plurality of game symbols are displayed is dependent on the display of ones of said first plurality of game symbols on said game field.

26. The method in accordance with claim 25 wherein the step of displaying ones of said second plurality of game symbols further comprises the step of moving ones of said first game symbols from ones of said first plurality of game symbol display positions to ones of said second plurality of game symbol display positions to be displayed as a second game symbol dependent on the display of ones of said first plurality of game symbols on said game field, to change the odds of winning at said second game.

27. The method in accordance with claim 25 wherein the step of displaying ones of said second plurality of game symbols further comprises the step of moving ones of said secondary game symbols from ones of said second plurality of game symbol display positions to others of said second plurality of game symbol display positions dependent on the display of ones of said first plurality of game symbols on said game field, to change the odds of winning at said second game.

28. The method in accordance with claim 25 wherein the player touches first game symbols displayed on the game field of said display device to indicate to said computer to move ones of said second plurality of game symbols from ones of said second plurality of game symbol display positions to others of said second plurality of game symbol display positions to change the odds of winning at said second game.

29. The method in accordance with claim 25 wherein the player touches first game symbols displayed on the game field of said display device indicate to said computer which of said first plurality of game symbols is to be moved from ones of said first plurality of game symbol display positions to ones of said second plurality of game symbol display positions to be displayed as second game symbols to change the odds of winning at said second game.

30. Apparatus for a player to play a series of rounds of a first game and a series of rounds of a second game that is physically integrated with said first game, with the goal being to win at both of said games, said apparatus comprising:

a display device;

a computer coupled to said display device and programmed to display a game field thereon for playing both said first game and said second game at the same time;

said computer displaying on said game field on said display device a first plurality of game symbols for playing a series of rounds of said first game, each of said series of rounds of said first game having a win or loss outcome; and said computer further displaying on said game field on said display device a second plurality of game symbols for playing said second game, and said second game may be won over a plurality of rounds of play of said first game and is won separately from winning said first game.

31. The invention in accordance with claim 30 wherein said computer displays on said game field a first plurality of symbol display positions for said first game and in which said computer displays said first plurality of game symbols, and said computer also displays on said game field a second plurality of symbol display positions for said second game and in which said computer displays said second plurality of game symbols.

32. The invention in accordance with claim 31 wherein said computer causes some of said second plurality of game symbols displayed in said second plurality of symbol display positions to persist in said second plurality of symbol display positions from one round of play of said first game to other rounds of play of said first game.

33. The invention in accordance with claim 32 wherein the display of said second plurality of game symbols in said second plurality of symbol display positions is dependent on the ones of said first plurality of game symbols being displayed by said computer in said first plurality of symbol display positions.

34. The invention in accordance with claim 33 wherein said computer moves ones of said secondary game symbols from ones of said second plurality of symbol display positions to others of said second plurality of symbol display positions responsive to the ones of said first plurality of game symbols being displayed by said computer in said first plurality of symbol display positions to change the odds of winning at said second game.

35. The invention in accordance with claim 33 wherein said computer moves ones of said first game symbols from ones of said first plurality of symbol display positions to ones of said second plurality of symbol display positions responsive to the ones of said first plurality of game symbols being displayed by said computer in said first plurality of symbol display positions to change the odds of winning at said second game.

36. A method for a player to play a series of rounds of a first game and a second game that is physically integrated with said first game, with the goal being to win at both of said games, said method comprising the steps of:

displaying a game field on a display device for playing both said first game and said second game at the same time said game field having a first plurality of symbol display positions and a second plurality of symbol display positions;

displaying a first plurality of game symbols in said first plurality of symbol display positions for playing a series of rounds of said first game, each of said series of rounds of said first game having a win/loss outcome; and displaying a second plurality of game symbols in said second plurality of symbol display positions for playing said second game, and said second game may be won over a plurality of rounds of play of said first game apart from winning said first game and is won separately from winning said first game.

37. The method in accordance with claim 36 further comprising the step of:

maintaining the display of said second plurality of game symbols in said second plurality of symbol display positions while the player plays a series of rounds of said first game, with combinations of said first plurality of game symbols indicating when said player achieves winnings from said first game, and with combinations of said second game symbols indicating when said player achieves winnings from said secondary game.

38. Apparatus for a player to play a series of rounds of a first game and a series of rounds of a second game that is physically integrated with said first game, with the goal being to win at both of said games, said apparatus comprising:

a display device;

a computer coupled to said display device and programmed to display a game field thereon for playing both said first game and said second game at the same time;

said computer displaying on said game field on display device a first plurality of game symbols for playing a series of rounds of said first game;

said computer further displaying on said game field on said display device a second plurality of game symbols for playing said second game, and said second game may be won apart from winning said first game; and means for providing touch screen operation to said display device, said computer cooperating with said touch screen means to determine where the player touches said game field on said display device to indicate to said computer particular game actions to be taken by said computer for playing said first and said second game.

39. The invention in accordance with claim 38 wherein said computer is responsive to said touch screen means indicating where said player touches said game field on said display device to move ones of said first plurality of game symbols to said secondary game where they are displayed as secondary game symbols.

40. The invention in accordance with claim 39 wherein said computer causes the display of some of said second plurality of game symbols to persist on said game field for said second game from one round of play of said first game to other rounds of play of said first game.

41. The invention in accordance with claim 39 wherein said computer is responsive to said touch screen means indicating where said player touches said game field on said display device to move ones of said secondary game symbols around to change the odds of winning at said second game.

42. A method for a player to play a series of rounds of a first game and a series of rounds of a second game that is physically integrated with said first game, with the goal being to win at both of said games, said method comprising the steps of:

displaying a game field on a display device for playing both said first game and said second game at the same time, said game field having a first plurality of game symbol display positions and a second plurality of game symbol display positions;

displaying a first plurality of symbols in said first plurality of game symbol display positions for playing a series of rounds of said first game, each of said series of rounds of said first game having a win or loss outcome;

displaying a second plurality of symbols in said second plurality of game symbol display positions for playing said second game; and touching ones of said first plurality of game symbol display positions in which said first game symbols are displayed to indicate to said computer particular game actions to be taken by said computer for playing said second game.

43. The method in accordance with claim 42 wherein the player touches said game field on said display device to indicate to said computer which of said first plurality of game symbols is to be moved from ones of said first plurality of game symbol display positions to ones of said second plurality of game symbol display positions to be displayed as secondary game symbols to change the odds of winning at said second game.

44. The method in accordance with claim 42 wherein the player touches said game field on said display device to indicate to said computer which of said second plurality of game symbols are to be moved from ones of said second plurality of game symbol display positions to others of said second plurality of game symbol display positions to change the odds of winning at said second game.

45. Apparatus for a player to play a series of rounds of a first game and a series of rounds of a second game that is physically integrated with said first game, with the goal being to win at both of said games, said apparatus comprising:

a display device;

a computer coupled to said display device and programmed to display a game field on said display device for playing both said first game and said second game at the same time;

said computer displaying on said game field on said display device a first plurality of game symbols for playing a series of rounds of said first game;

said computer further displaying on said game field on said display device a second plurality of game symbols for playing said second game; and wherein said computer causes the display of some of said second plurality of game symbols to persist on said game field from one round of play of said first game to other rounds of play of said first game, and said second game is played and may be won over a plurality of rounds of play of said first game.

46. The invention in accordance with claim 45 wherein the display of ones of said second plurality of game symbols on said game field is dependent on ones of said first plurality of game symbols being displayed by said computer on said game field.

47. The invention in accordance with claim 45 wherein after each round of play of said first game said computer changes the position in which ones of said second plurality of game symbols are displayed from one position on said display device to another position on said display device to change the odds of winning at said second game.

48. The invention in accordance with claim 45 wherein after each round of play of said first game said computer moves ones of said first game symbols from said first game to said second game to be displayed as second game symbols to change the odds of winning at said second game.

49. The invention in accordance with claim 48 further comprising:

means for providing touch screen operation to said display device, said computer cooperating with said touch screen means to determine where the player touches said game field on said display device to indicate to said computer which of said first plurality of game symbols is to be moved to said second game where they are displayed as second game symbols to change the odds of winning at said second game.

50. The invention in accordance with claim 47 wherein said computer is responsive to said player using said touch screen means to determine where the player touches said game field on said display device to indicate to said computer which of said secondary game symbols are to be moved from one position on said display device to another position on said display device to change the odds of winning at said second game.

51. A method for a player to play a series of rounds of a first game and a series of rounds of a second game that is physically integrated with said first game, with the goal being to win at both of said games, said method comprising the steps of:

displaying a game field on a display device for playing both said first game and said second game at the same time;

displaying a first plurality of symbols on said game field for playing a series of rounds of said first game;

maintaining the display of ones of said second plurality of game symbols on said game field while the player plays a series of rounds of said first game, with combinations of said first plurality of game symbols indicating when said player achieves winnings from said first game, and with combinations of said second plurality of game symbols indicating when said player achieves winnings from said secondary game.

52. The method in accordance with claim 51 wherein the step of displaying a second plurality of symbols on said game field comprises moving ones of said first game symbols to said second game to be displayed as a second game symbol on said game field to change the odds of winning at said second game.

53. The method in accordance with claim 51 wherein the step of displaying ones of said second plurality of game symbols comprises the step of changing the position where ones of said second game symbols are displayed on said game field to change the odds of winning at said second game.

54. The method in accordance with claim 53 wherein the player touches said game field on said display device to indicate to said computer to move ones of said second plurality of game symbols from one position on said display device to another position on said display device to change the odds of winning at said second game.

55. The method in accordance with claim 52 wherein the player touches said game field on said display device to indicate to said computer to move ones of said first plurality of game symbols to said second game to be displayed as second game symbols to change the odds of winning at said second game.

* * * * *